US006112440A

United States Patent [19]

Böttcher et al.

[11] Patent Number: 6,112,440

[45] Date of Patent: Sep. 5, 2000

[54] EXTENDABLE IRONING BOARD

[75] Inventors: Wolfram-Dietrich Böttcher, Mötzingen; Joachim Krauss, Wildberg; Reinhold Oettl, Nufringen; Ronald Walther, Nagold, all of Germany

[73] Assignee: Häfele GmbH & Co., Nagold, Germany

[21] Appl. No.: 09/071,789

[22] Filed: May 1, 1998

[30] Foreign Application Priority Data

May 1, 1997 [DE] Germany ..... 297 07 830 U

[51] Int. Cl.[7] ..... D06F 81/06

[52] U.S. Cl. ..... 38/139

[58] Field of Search ..... 38/104, 103, 139, 38/140, 66, DIG. 3, 137; 108/115, 117, 128

[56] References Cited

U.S. PATENT DOCUMENTS

| | | | |
|---|---|---|---|
| 508,595 | 11/1893 | Barrett | 38/137 X |
| 2,101,142 | 12/1937 | Jensen et al. | 38/102 |
| 2,313,135 | 3/1943 | Fay | 38/137 |
| 2,313,181 | 3/1943 | Thomas | 38/137 |
| 2,516,235 | 7/1950 | Morgan | 38/139 X |
| 2,645,046 | 7/1953 | Frej | 38/137 |
| 3,105,176 | 9/1963 | Freeman | 38/140 |
| 3,732,639 | 5/1973 | Elder | 38/139 |
| 5,241,766 | 9/1993 | Walz et al. | 38/139 X |
| 5,444,928 | 8/1995 | Sagel | 38/139 |

*Primary Examiner*—Ismael Izaguirre
*Attorney, Agent, or Firm*—Friedrich Kueffner

[57] ABSTRACT

An extendable ironing board includes a front component which can be folded onto a rear component, wherein the rear component is arranged on a pull-out component so as to be pivotable through at least one parallelogram lever pair from a lower position of rest into an upper work position, and wherein the pull-out component is slideably mounted in a guide member. A control cam is provided at the pull-out component or the rear component and a lifting element is provided at the respectively other component for at least initially raising the rear component when the ironing board is extended by travelling onto the control cam.

15 Claims, 6 Drawing Sheets

EXTENDABLE IRONING BOARD

BACKGROUND OF THE INVENTION

1. Field of the Invention

The present invention relates to an extendable ironing board with a front component which can be folded onto a rear component, wherein the rear component is arranged on a pull-out component so as to be pivotable through at least one parallelogram lever pair from a lower position of rest into an upper work position, and wherein the pull-out component is slideably mounted in a guide means.

2. Description of the Related Art

In known ironing boards of the above-described type, a horizontal pull-out movement is converted through two parallelogram lever pairs into a movement which raises the rear component. As the angle between the parallelogram levers and the pull-out direction increases, this horizontal pull-out movement can be more easily and better converted into a vertical component of movement which raises the rear component and the front component. However, in the known ironing boards, the minimum angle should not be less than a certain value, so that the pull-out movement can be converted with an acceptable application of force into a raising force. Because this angle should not drop below a minimum value, the structural height of the unextended ironing board cannot be reduced as desired.

SUMMARY OF THE INVENTION

Therefore, it is the primary object of the present invention to further develop an ironing board of the above-described type in such a way that the structural height of the ironing board can be further reduced even though it uses parallelogram levers.

In accordance with the present invention, a control cam is provided at the pull-out component or the rear component and a lifting element is provided at the respectively other component for at least initially raising the rear component when the ironing board is extended by travelling onto the control cam.

Accordingly, the ironing board according to the present invention has the significant advantage that the control cam and the lifting element can support or initiate the upward pivoting movement of the rear component together with the front component. This makes it possible to arrange the parallelogram levers at angles relative to the pull-out direction which are smaller than the previous minimum angle and, thus, to reduce the structural height of the ironing board. In particular, in their lower position of rest, the parallelogram levers may also extend parallel to the pull-out direction or even beyond the pull-out direction. The interaction of the control and the lifting element makes it possible to pivot the parallelogram levers upwardly when the ironing board is extended at least to such an extent that the minimum angle is reached and, thus, the previously existing unfavorable lever conditions are overcome.

In accordance with a particularly preferred embodiment, the control cam extends in the pull-out direction obliquely relative to the pull-out direction, wherein the control cam may be curved, for example, concavely, in order to optimize the lever conditions which act during the extension of the ironing board.

An advantageous further development of this embodiment provides that the control cam is formed by an inclined surface of a wedge element arranged on the rear component. This wedge element travels onto a lifting element when the ironing board is extended, so that the wedge element is raised together with the rear component and the front component.

In a preferred embodiment of the invention, the lifting element is a stirrup element mounted on the pull-out component and engaging in the travel path of the control cam. This stirrup element forms an abutment onto which, for example, the wedge element mounted on the rear component can travel in a supporting manner.

To ensure that the rear component is automatically pivoted upwardly into its upper work position during the extension process, the rear component is held back in pull-out direction by a holding element at least after having been raised by the lifting element.

The holding element preferably is a holding rod which is connected at one end to the pull-out component and at the other end to the rear component. The holding rod may be elastic or resilient in connecting direction, or, in accordance with a preferred feature, the holding rod may be rigid, which may be advantageous, for example, when assembling and disassembling the holding rod.

If a force, particularly a spring force, acts on the rear component at least during the initial extension of the ironing board in the direction toward its upper work position, the force required for pulling out the ironing board is reduced accordingly.

For this purpose, in accordance with a further development of the invention, for example, a tension spring may be supported at its rearward end as seen in pulling-out direction at the rear component and at its front end at least during the initial extension of the ironing board at the pull-out component. When extending or pulling out the ironing board, the tension spring acting between the rear component and the pull-out component reinforces and facilitates the pull-out movement.

In accordance with a particularly advantageous feature of this further development, the front end of the tension spring is mounted on an anchor element which is displaceably held at the rear component approximately in pull-out direction and is locked with the pull-out component at least during the initial extension of the ironing board.

In order to ensure that the tension spring does not continuously act even when the ironing board has been extended, guide means for the anchor element are provided which make the anchor element releasable from the locking engagement with the pull-out component when the ironing board is extended, and, during the opposite movement of the ironing board, make the anchor element guidable into the locking engagement with the pull-out component. For example, the anchor element may be mounted so as to be pivotable, wherein the anchor element may be pivoted through the guide means into or out of the locking engagement.

In accordance with another feature of the present invention, a support carrier for the front component is hinged to the rear component, wherein the support carrier is moved out when the ironing board is extended. The rearward end of the tension spring rests on the support carrier and the anchor element is guided in the support carrier.

Another aspect of the present invention is that it also relates to an ironing board with a support surface. In order to keep low the thermal expansion of the support surface which is also heated during ironing, metal stretch-type grids with rhombic openings are already known as support surfaces. However, these stretch-type grids can still expand when heated to such an extent that an undesired wave-shaped support or ironing surface is formed.

Accordingly, it is another object of the present invention to provide an ironing board in which the thermal expansion of the support surface is as small as possible.

In accordance with the present invention, the support surface of the ironing board is provided with a pattern of holes with first and second openings extending in longitudinal and transverse directions alternatingly approximately longitudinally and transversely.

As a result of these openings, the thermal expansion is always limited to only the short distance between two adjacent openings, so that heating of the support surface does not result in an expansion of the entire support surface, but the expansion is kept within the support surface due to the expansion of the short spaces between the openings. The openings are as much as possible geometrically adapted to each other in such a way that a continuous straight connecting line without interruption by openings does not exist in any direction of the support surface. Such a whole pattern can be manufactured particularly easily as an endless sheet from which the actual ironing surface is then cut.

In accordance with a particularly preferred embodiment, first or second openings located adjacent to each other in longitudinal direction of the support surface are offset relative to each other in the transverse direction in order to effectively interrupt the thermal expansion of the support surface as much as possible in all directions.

In accordance with another advantageous embodiment, it is provided that additional third openings, preferably round holes, are arranged between adjacent first and second openings.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
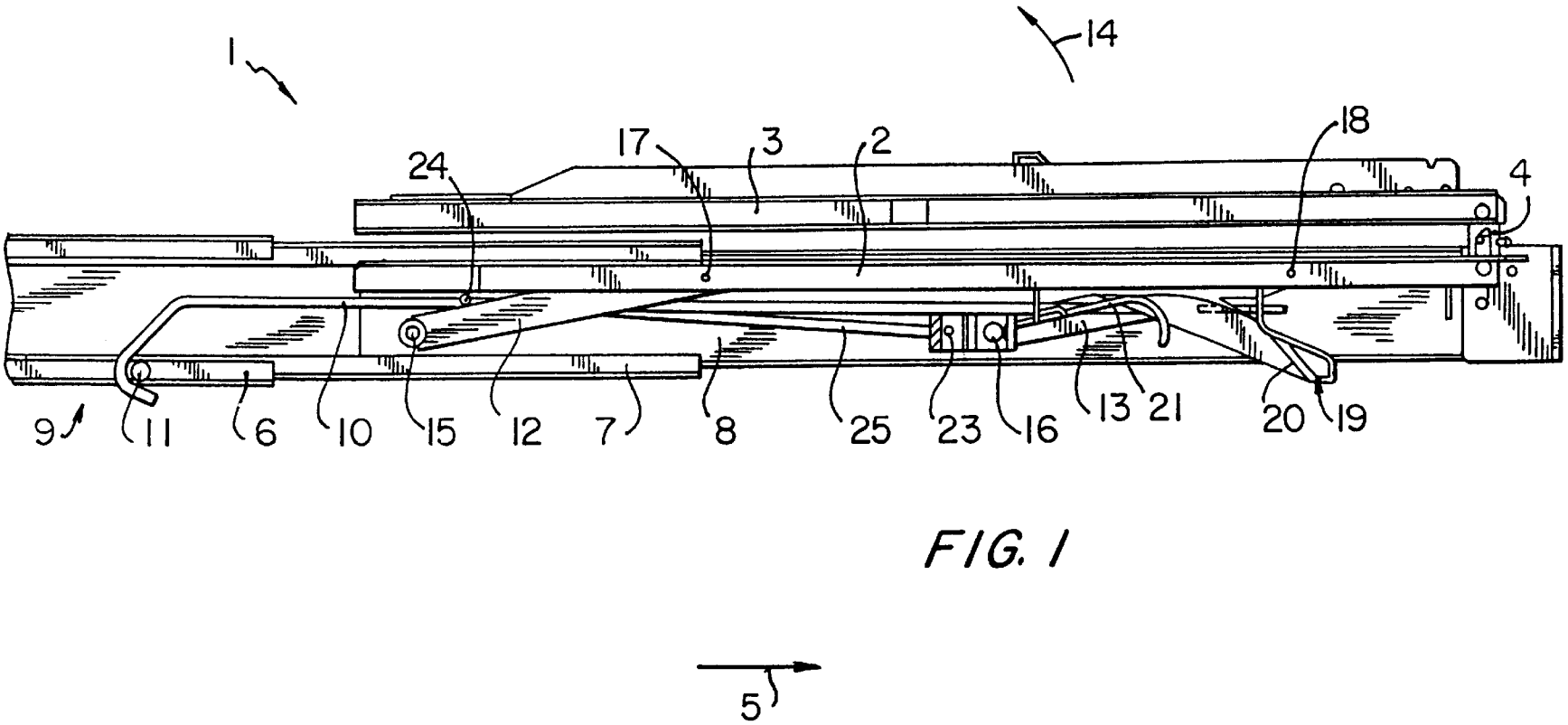
FIG. 1 is a partial side view of a first embodiment of an extendable ironing board shown in an already slightly pulled-out position.
Figure 2:
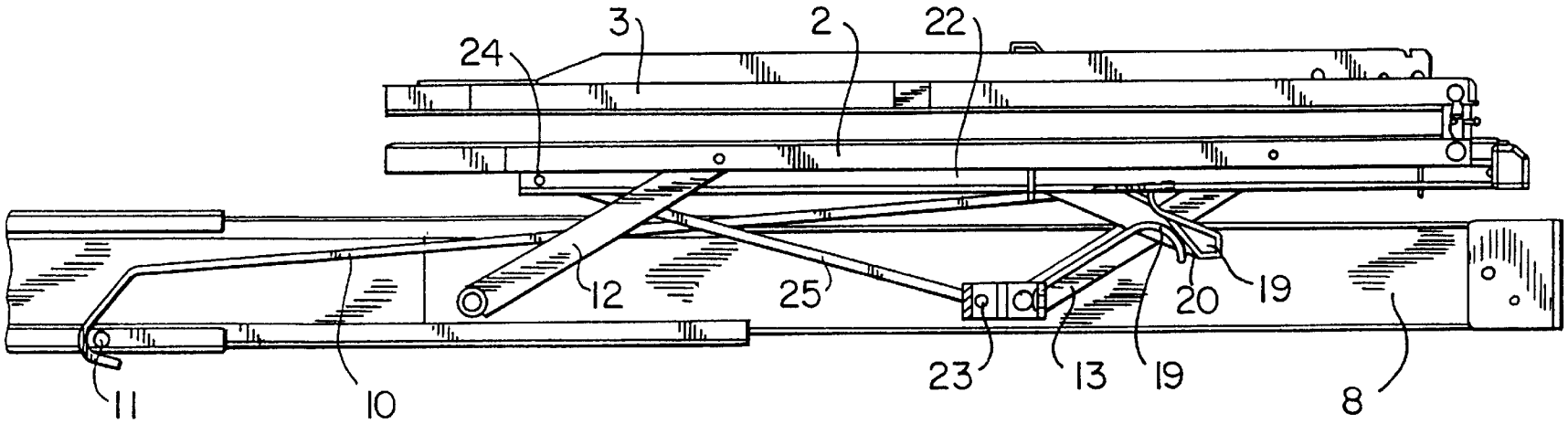
FIG. 2 is a side view of the ironing board of FIG. 1, shown in a further pulled-out middle position.
Figure 3:
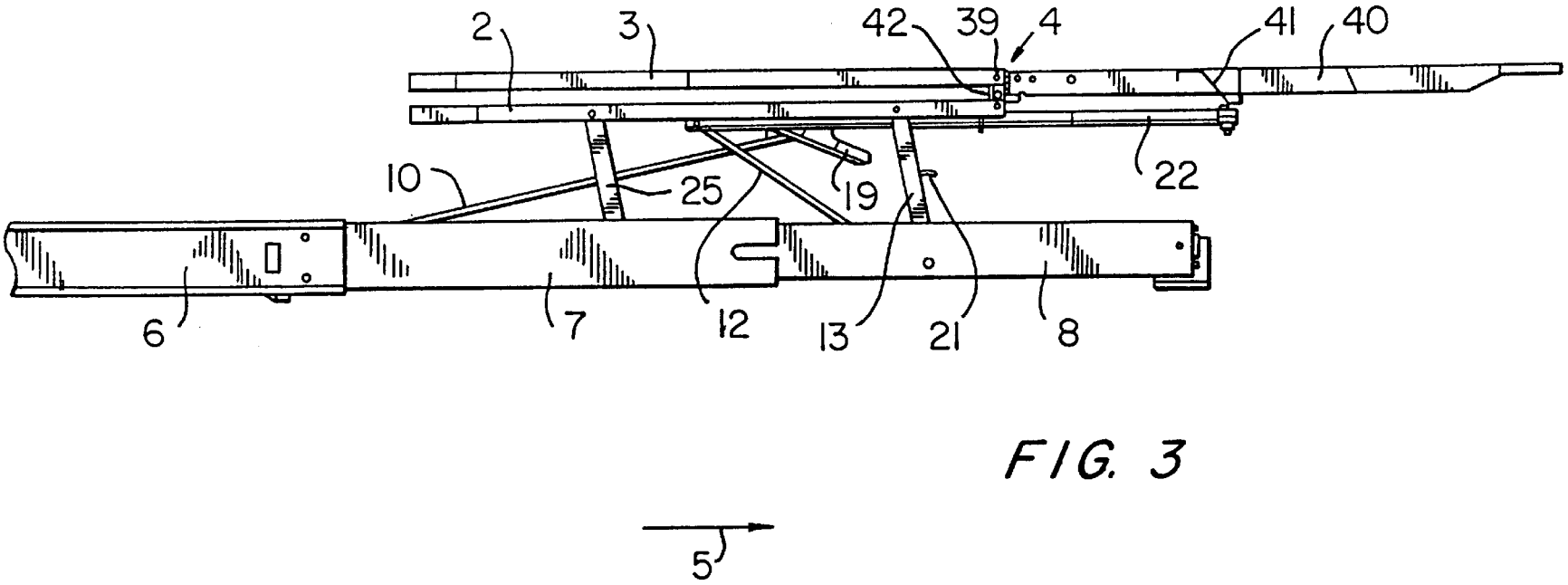
FIG. 3 is a side view of the ironing board of FIG. 1, shown in the completely extended upper work position.

The work surface of an ironing board 1 is composed of a rear component 2 and a front component 3 which are connected to each other through a hinge 4, so that, as illustrated in FIGS. 1 to 3, the front component 3 can be folded onto the rear component 2. The folded-up ironing board can be pulled from its position mounted within a drawer, not shown, in the direction of arrow 5. For this purpose, a pull-out component 9 composed of telescopic rails 6, 7 and 8 is provided. The front end of a support rod 10 is fastened to the rear component 2, wherein the support rod 10 is hook-shaped at its rearward free end.

When the front telescopic rail 8 is pulled, the telescopic rails 6, 7 and 8 are moved out until the rearward end of the support rod 10 makes contact with a pin 11 provided at the rearward telescopic rail 6, as shown in FIG. 1. The support rod 10 then pulls the entire arrangement mounted on the telescopic rails 6, 7 and 8 toward the rear, so that two parallelogram lever pairs 12 and 13 pivotally hinged to the rear component 2 move upwardly in the direction of arrow 14. The parallelogram levers 12, 13 are fastened through hinges 15, 16 to the front telescopic rail 8 and through hinges 17, 18 to the rear component 2. When the front telescopic rail is pulled further, the ironing board changes from the middle position shown in FIG. 2 into the upper work position shown in FIG. 3 in which the rearward end of the rear component 2 makes contact with the front edge of a work plate, not shown.

In order to initiate or support pivoting of the parallelogram levers 12, 13, a downwardly projecting wedge element 19 with a concavely curved control cam 20 directed against the pull-out direction 5 is provided at the bottom side of the rear component 2. An upwardly protruding stirrup-shaped lifting element 21 is provided on the front telescopic rail 8 behind the wedge element 19 as seen in pull-out direction, wherein, when the ironing board is extended, the wedge element 19 travels with its control cam 20 onto the lifting element 21 when the support rod 10 makes contact with the pin 11. When the wedge element 19 travels onto the lifting element 21, the arrangement is pivoted upwardly in the pivoting direction 14 and is raised by about 60 to 80 mm, so that the lever conditions in the parallelogram levers 12, 13 are now such that the further pull-out movement can be simply and easily further converted into a movement in the pivoting direction 14 by means of the parallelogram 12, 13.

As shown in FIGS. 2 and 3, a support carrier 22 is displaceably mounted on the rear component 2, wherein the front end of the support carrier 22 serves as support for the folded-out front component 3. When the ironing board 2 is extended in the pull-out direction 5, a push arm 25 hinged to the front telescopic rail 8 at 23 and to the support carrier 22 at 24 is pivoted against the pivoting direction 14, i.e., opposite to the parallelogram levers 12, 13 and pushes the support carrier 22 in the pull-out direction 5 toward the front over the rear component 2.

FIG. 3 shows the ironing board 1 in its upper work position and it can be seen that the wedge element 19 with its control cam 20 has only initially interacted in a supporting manner with the lifting element 21.

In addition, a sleeve board 40 is pivotally mounted on the hinge 4 at 39, wherein the sleeve board 40 can be pivoted upwardly in a clockwise direction when the rear component 2 is folded onto the front component 3 until a support 41 rests on the support carrier 22, as shown in FIG. 3. The upper sides of the front component 3 and the sleeve board 40 form a flat support surface. If, on the other hand, the front component 3 is pivoted in the clockwise direction, the hinge is turned about 42, so that the front component is extended by the length of the hinge 4 in the pull-out direction. This moves the support 41 out of the area of the support carrier 22 and the front component 3 rests directly on the support carrier 22, so that the rear component 2 and the front component 3 form a flat support surface.

Figure 4:
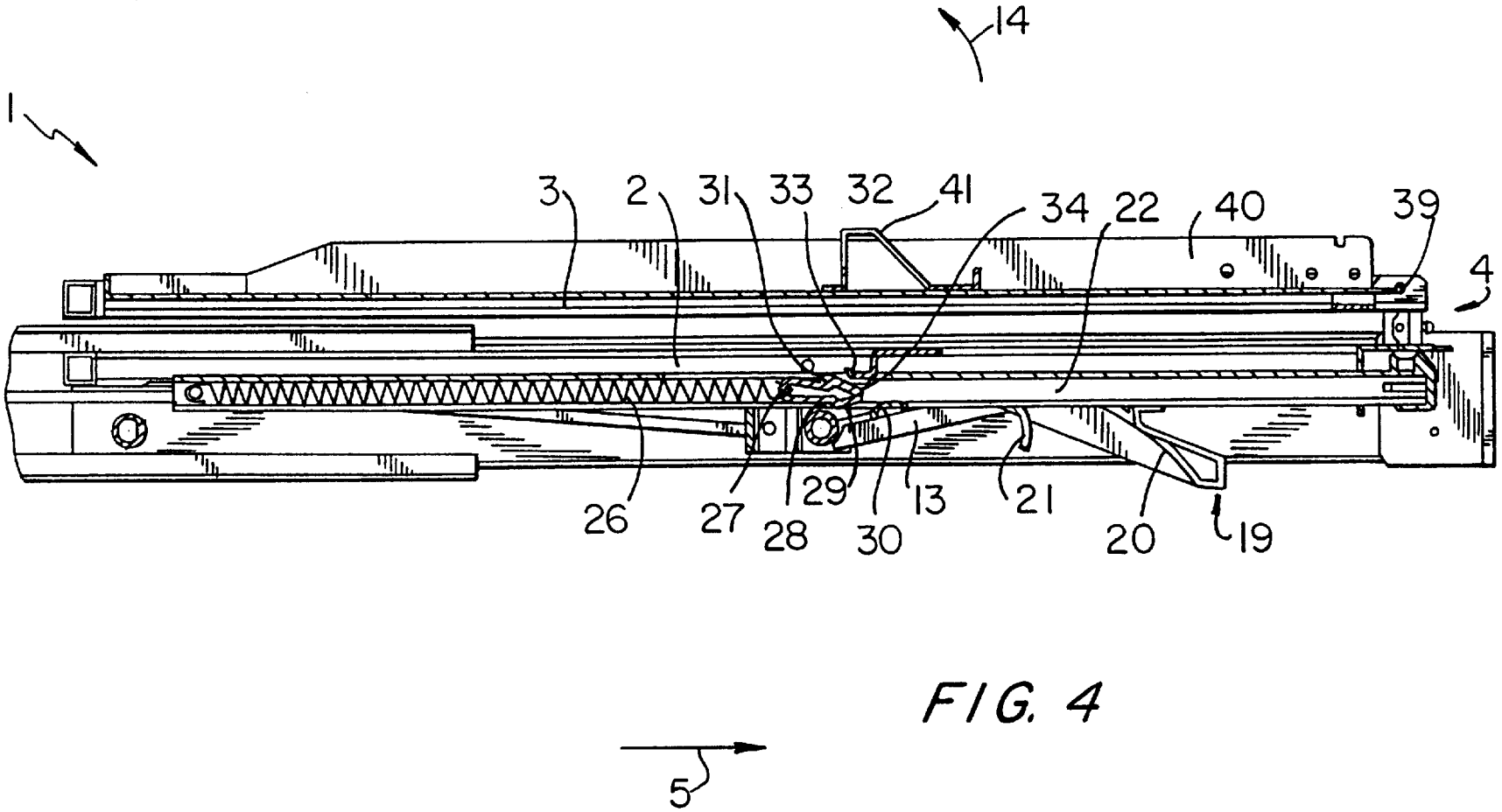
FIG. 4 is a sectional view of a second embodiment of the extendable ironing board shown in a position corresponding to that of FIG. 1.
Figure 5:
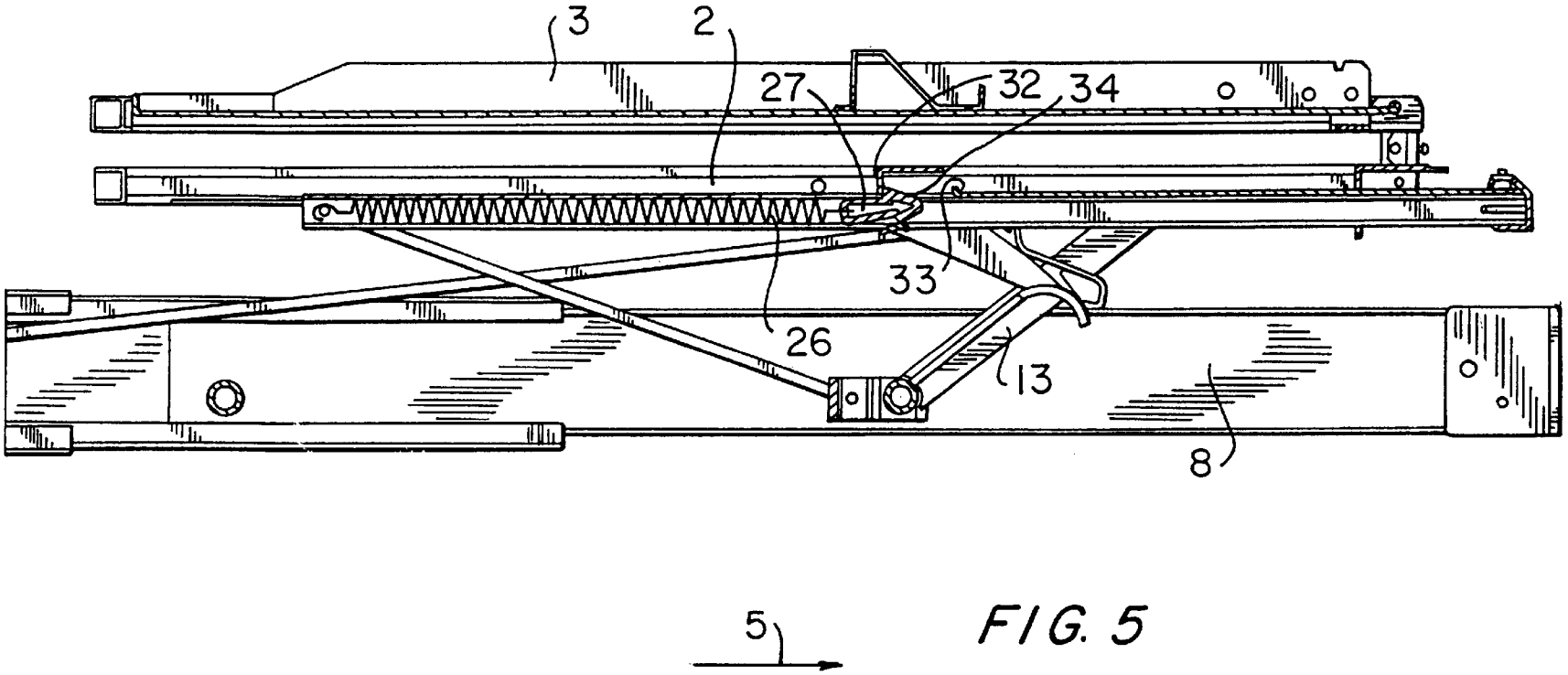
FIG. 5 is a side view of the ironing board of FIG. 4, shown in a middle position corresponding to that of FIG. 2.

FIGS. 4 and 5 of the drawing show a second embodiment of an extendable ironing board 1 in which an additional tension spring 26 supporting the pull-out movement is provided. The tension spring 26 is at its rearward end attached to the rear component 2 and at its front end to an anchor element 27 which is slideably guided in the support carrier 22 in the pull-out direction 5. In the lower position of rest of the ironing board 1 shown in FIG. 4, the tension spring 26 is tensioned and the anchor element 27 engages in a locking manner with a lower step 28 behind a projection of the front telescopic rail 8. This pretensions the rear component 2 relative to the front telescopic rail 8, so that the force to be applied for pulling out and pivoting the ironing board 2 in directions 5 and 14 is lower as compared to the force required in the embodiment of FIGS. 1 to 3.

When the ironing board is further extended, the anchor element 27 travels with its lower inclined front surface 29 onto an inclined lower guide means 30 of the rear component, so that the anchor element 27 is pivoted in a counter-clockwise direction. The anchor element 27 is released from the locking engagement with the front telescopic rail 8 and is further pivoted by the lower guide means 30 until it engages in a locking manner with an upper step 31 in a guide angle 32 of the rear component 2 for the support carrier 22. In this position, the tension spring 26 is essentially untensioned.

When the ironing board 1 is pushed in from the position shown in FIG. 5 back into the position of FIG. 4, an upper guide means 33 travels on the inwardly moving support carrier 22 onto an upper inclined front surface 34 of the anchor element 27. As a result, the anchor element 27 is turned in the clockwise direction and is released from the locking engagement with the guide angle 32 and is further pivoted until in the lower position of rest shown in FIG. 4 the anchor element 27 engages with a lower step 28 again behind the projection of the front telescopic rail 8. In this position, the tension spring 26 is again tensioned.

Figure 6:
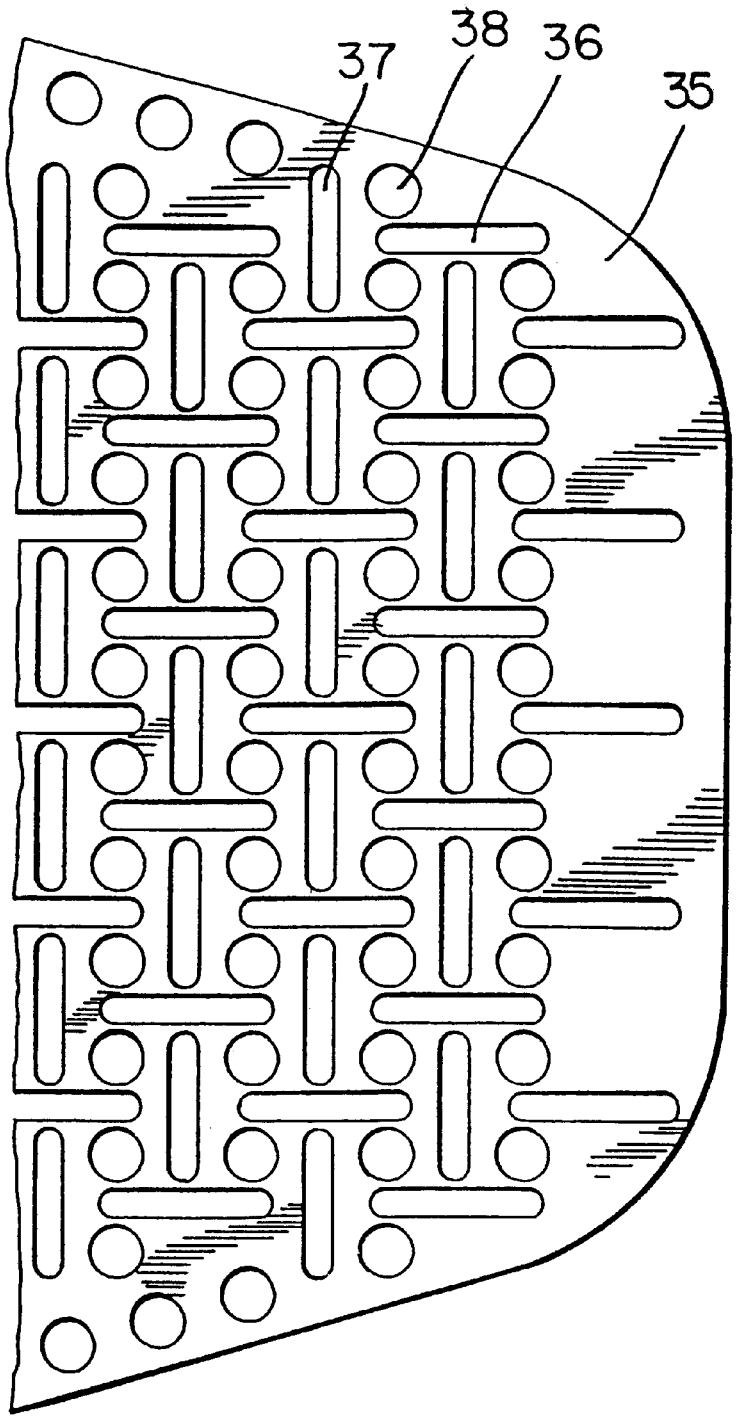
FIG. 6 is a partial top view of a front portion of the support surface of the ironing board.

FIG. 6 shows the support surface 35 of the ironing board 1 in the front area of the front component 3. The support surface 35 is provided with a pattern of holes which includes first and second openings 36 and 37 in the form of oblong holes which extend in longitudinal and transverse directions alternatingly longitudinally and transversely. In the longitudinal direction of the support surface 35, adjacent first openings 36 and adjacent second openings 37 are arranged offset relative to each other in the transverse direction. In addition, additional third openings 38 in the form of round holes are arranged between adjacent first openings 36 and second openings 37.

As a result of these openings 36, 37 and 38, the thermal expansion of the support surface 35 is limited to only the short spaces between two adjacent openings, so that heating of the support surface 35 does not result in an expansion of the entire support surface, but the expansion takes place within the support surface by an expansion of the short spaces into the openings. The openings 36, 37 and 38 are arranged geometrically relative to each other in such a way that a continuous straight connecting line without interruptions by openings does not exist in any direction of the support surface 35.

While specific embodiments of the invention have been shown and described in detail to illustrate the inventive principles, it will be understood that the invention may be embodied otherwise without departing from such principles.

We claim:

1. An extendable ironing board comprising a rear component and a front component-foldable onto the rear component, a pull-out component displaceably mounted in a guide means, at least one parallelogram lever pair for pivoting the rear component on the pull-out component from a lower position of rest into an upper work position, further comprising a control cam mounted on one of the pull-out component and the rear component and a lifting element mounted on another of one of the pull-out component and the rear component for raising the rear component at least initially when the ironing board is pulled out by travelling onto the control cam.

2. The ironing board according to claim 1, wherein the control cam extends obliquely relative to a pull-out direction.

3. The ironing board according to claim 2, wherein the control cam is an inclined surface of a wedge element mounted on the rear component.

4. The ironing board according to claim 1, wherein the lifting element is a stirrup element arranged on the pull-out component and engaging in a path of movement of the control cam.

5. The ironing board according to claim 1, comprising a holding element for holding back the rear component in the pull-out direction at least after the rear component has been raised by the lifting element.

6. The ironing board according to claim 5, wherein the holding element is a holding rod having first and second ends, wherein the first end of the holding rod is connected to the pull-out component and the second end of the holding rod is connected to the rear component.

7. The ironing board according to claim 1, comprising means for applying a force on the rear component at least during the initial pulling-out of the ironing board in the direction toward the upper work position.

8. The ironing board according to claim 7, wherein the means for applying a force is a spring.

9. The ironing board according to claim 7, comprising a tension spring resting with a rearward end in the pull-out direction on the rear component and at a front end at least during the initial pulling-out of the ironing board against the pull-out component.

10. The ironing board according to claim 9, comprising an anchor element, the front end of the tension spring being mounted on the anchor element, wherein the anchor element is slideably mounted on the rear component approximately in the pull-out direction and is locked with the pull-out component at least during the initial pulling-out of the ironing board.

11. The ironing board according to claim 10, comprising guide means for the anchor element for releasing the anchor element from locking engagement with the pull-out component when the ironing board is pulled out and for guiding the anchor member into locking engagement with the pull-out component when the ironing board is moved in a direction opposite the pull-out direction.

12. The ironing board according to claim 10, comprising a support member for the front component, the support carrier being mounted on the rear component such that the support carrier is pulled out when the ironing board is pulled out, wherein the rearward end of the tension springs rests on the support carrier and the anchor element is guided in the support carrier.

13. An extendable ironing board comprising a rear component and a front component foldable onto the rear component, a pull-out component displaceably mounted in a guide means, at least one parallelogram lever pair for pivoting the rear component on the pull-out component from a lower position of rest into an upper work position, further comprising a control cam mounted on one of the pull-out component and the rear component and a lifting element mounted on another of one of the pull-out component and the rear component for raising the rear component at least initially when the ironing board is pulled out by travelling onto the control cam, the rear component and the front component forming a support surface, wherein the support surface has a pattern of openings comprising first and second openings extending alternatingly in longitudinal and transverse directions approximately longitudinally and transversely of the ironing board.

14. The ironing board according to claim 13, wherein adjacent first and second openings in the longitudinal direction of the support surface are arranged offset relative to each other in the transverse direction.

15. The ironing board according to claim 13, further comprising third openings arranged between adjacent first and second openings.

* * * * *